US006676503B2

(12) United States Patent
Hill et al.

(10) Patent No.: US 6,676,503 B2
(45) Date of Patent: Jan. 13, 2004

(54) EXHAUST GAS NOZZLE FOR FAN

(75) Inventors: Alan Hill, Oakville (CA); Paul Sixsmith, Mississauga (CA)

(73) Assignee: Plasticair Inc., Mississauga (CA)

( * ) Notice: Subject to any disclaimer, the term of this patent is extended or adjusted under 35 U.S.C. 154(b) by 0 days.

(21) Appl. No.: 10/313,167

(22) Filed: Dec. 6, 2002

(65) Prior Publication Data

US 2003/0114098 A1 Jun. 19, 2003

Related U.S. Application Data

(60) Provisional application No. 60/339,346, filed on Dec. 13, 2001, and provisional application No. 60/399,165, filed on Jul. 30, 2002.

(51) Int. Cl.[7] ..... F23L 17/02
(52) U.S. Cl. ..... 454/17
(58) Field of Search ..... 454/3, 4, 16, 17

(56) References Cited

U.S. PATENT DOCUMENTS

| | | | | | |
|---|---|---|---|---|---|
| 352,597 | A | | 11/1886 | Wohlfert | |
| 1,299,286 | A | * | 4/1919 | Bartholomew | 454/17 |
| 1,327,879 | A | * | 1/1920 | Pruden | 454/17 |
| 1,507,462 | A | * | 9/1924 | Childers et al. | 454/17 |
| 1,582,373 | A | * | 4/1926 | Beck | 454/17 |
| 1,684,026 | A | * | 9/1928 | Hawley | 454/17 |
| 2,188,564 | A | | 1/1940 | Berg | |
| 2,265,112 | A | | 12/1941 | Davies | |
| 3,385,197 | A | | 5/1968 | Greber | |
| 3,719,032 | A | | 3/1973 | Cash | |
| 3,797,373 | A | | 3/1974 | Larson | |
| 4,806,076 | A | | 2/1989 | Andrews | |
| 5,439,349 | A | | 8/1995 | Kupferberg | |
| 6,112,850 | A | | 9/2000 | Secrest et al. | |

* cited by examiner

*Primary Examiner*—Derek Boles
(74) *Attorney, Agent, or Firm*—Gifford, Krass, Groh, Sprinkle, Anderson & Citkowski, P.C.

(57) ABSTRACT

An exhaust gas nozzle comprising a duct member forming a single exhaust passage and defining an open first end, an open second end, and a centrally-disposed longitudinal axis extending between the first end and the second end. The duct member includes at least a pair of bent wall portions spaced-apart from one another, these bent wall portions extending from the first end to the second end and gradually and increasingly pinching the passage from the first end to the second end. An annular, open-ended windband is connected to the duct member and disposed about the exterior of and in spaced, coaxial relation to the second end. A windband inlet is located below and in the region of the second end and outside the duct member.

20 Claims, 9 Drawing Sheets

EXHAUST GAS NOZZLE FOR FAN

PRIOR APPLICATIONS

This application claims priority based on U.S. Provisional Application No. 60/339,346 filed Dec. 13, 2001 and also on U.S. Provisional Application No. 60/399,165 filed Jul. 30, 2002.

FIELD OF THE INVENTION

The present invention relates to the field of exhaust ducts and exhaust stacks for fans and the like.

BACKGROUND OF THE INVENTION

Many exhaust gases are noxious. Accordingly, it is desirable, when constructing exhaust systems, for buildings or the like, to attempt to ensure that exhaust gases do not persist at low altitudes, but instead travel upwardly, into the atmosphere.

Tall exhaust stacks can be highly effective in this regard, even in the context of exhaust gases exiting therefrom at relatively low velocities. However, tall exhaust stacks are relatively costly and difficult to construct. Moreover, same are unsightly, and can also exceed height restrictions imposed under zoning by-laws.

Accordingly, it has been attempted to approximate the performance of tall stacks by the use of upblast fans, which exhaust gases at high velocity through relatively short stacks of conventional construction. However, such structures have proven deficient in terms of their ability to propel exhaust gases upwardly into the atmosphere. It has been found, for example, that atmospheric currents can create eddies adjacent to building rooflines, which can entrain gases exhausted from conventional short stacks even when exiting at relatively high velocities.

One class of upblast fan which can be relatively effective in the propulsion of exhaust gases upwardly into the atmosphere is characterized by a radial fan which exhausts into a bifurcated nozzle defining opposed flow chambers, each being substantially arcuate in horizontal cross-section and collectively tapering upwardly to an outlet, with a passive zone chamber defined between the chambers that is open to the atmosphere. The structures described in U.S. Pat. No. 4,806,076 (Andrews), issued Feb. 21, 1989; U.S. Pat. No. 5,439,349 (Kupferberg), issued Aug. 8, 1995; and U.S. Pat. No. 6,112,850 (Secrest et al.), issued Sep. 5, 2000, are all exemplary of this class.

It is an object of the present invention to provide a novel nozzle for an upblast fan enables the propulsion of exhaust gases upwardly into the atmosphere.

SUMMARY OF THE INVENTION

According to one aspect of the invention, an exhaust gas nozzle comprises a vertically extending duct member forming an exhaust passage that extends from an open bottom end to an open top end of the duct member. A centrally disposed, vertically extending longitudinal axis extends between the first and second ends. The duct member is formed by a duct wall that extends peripherally around the longitudinal axis and that has at least two longitudinally extending, bent wall portions distributed substantially evenly about the periphery of the duct member. These bent wall portions gradually and increasingly pinch the passage in the direction of the second end by bending and projecting radially inwardly towards the longitudinal axis as seen from the top end of the duct member.

In a preferred embodiment, the gas nozzle includes an annular, open-ended cap connected to the duct member and disposed about the exterior of and in spaced, substantially coaxial relation to the second end of the duct member. The cap has a cap inlet located in the region of the second end and outside the duct member and a cap outlet located above the second end.

According to another aspect of the invention, an exhaust gas nozzle comprises a duct member forming a single exhaust passage that extends from an open, first end to an open second end of the duct member. A centrally disposed longitudinal axis extends between the first and second ends. The duct member is formed by a duct wall having at least two longitudinally extending bent wall portions that are distributed substantially evenly about the periphery of the duct member, which extends about the longitudinal axis. Each bent wall portion projects inwardly towards the longitudinal axis as seen in transverse planes in the region of the second end whereby the bent wall portions gradually and increasingly pinch the single passage in the direction of the second end. An annular cap is connected to the duct member and is disposed about the exterior of and in spaced, substantially coaxial relation to the second end of the duct member. The cap has a cap inlet located between the first and second ends and outside the duct member. A cap outlet is located outwardly from the second end in the direction of the longitudinal axis.

In one preferred embodiment of this nozzle, there are only two of the bent wall portions which are located diametrically opposite one another. In other versions of the nozzle, there can be three or four bent wall portions distributed about the periphery of the duct member.

Other advantages, features and characteristics will become more apparent upon consideration of the following detailed description with reference to the accompanying drawings, the latter being briefly described hereinbelow.

DETAILED DESCRIPTION OF PREFERRED EMBODIMENTS

Figure 1:
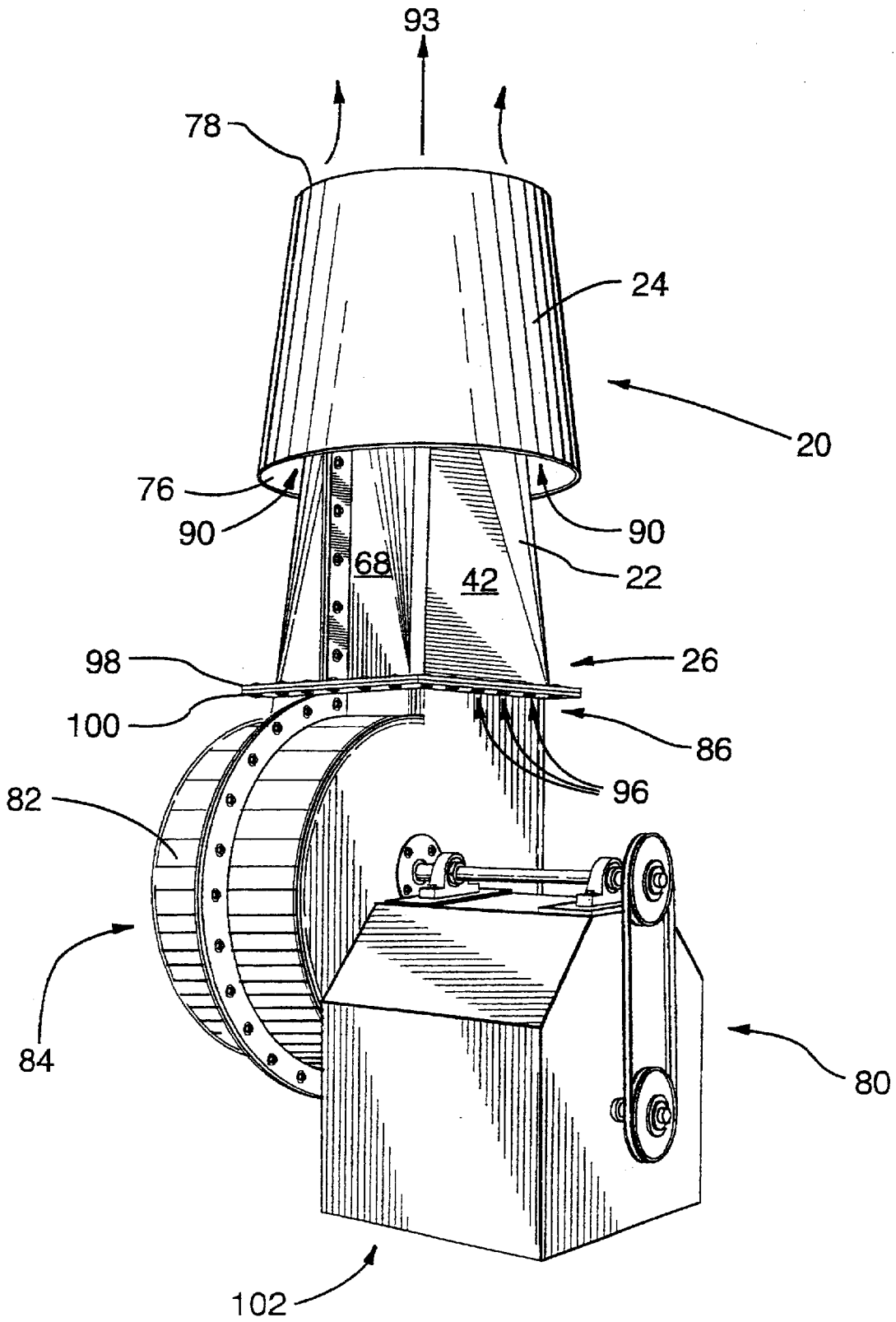
FIG. 1 is a perspective view of a nozzle according to a preferred embodiment of the present invention, operatively mounted to a radial fan apparatus.
Figure 2:
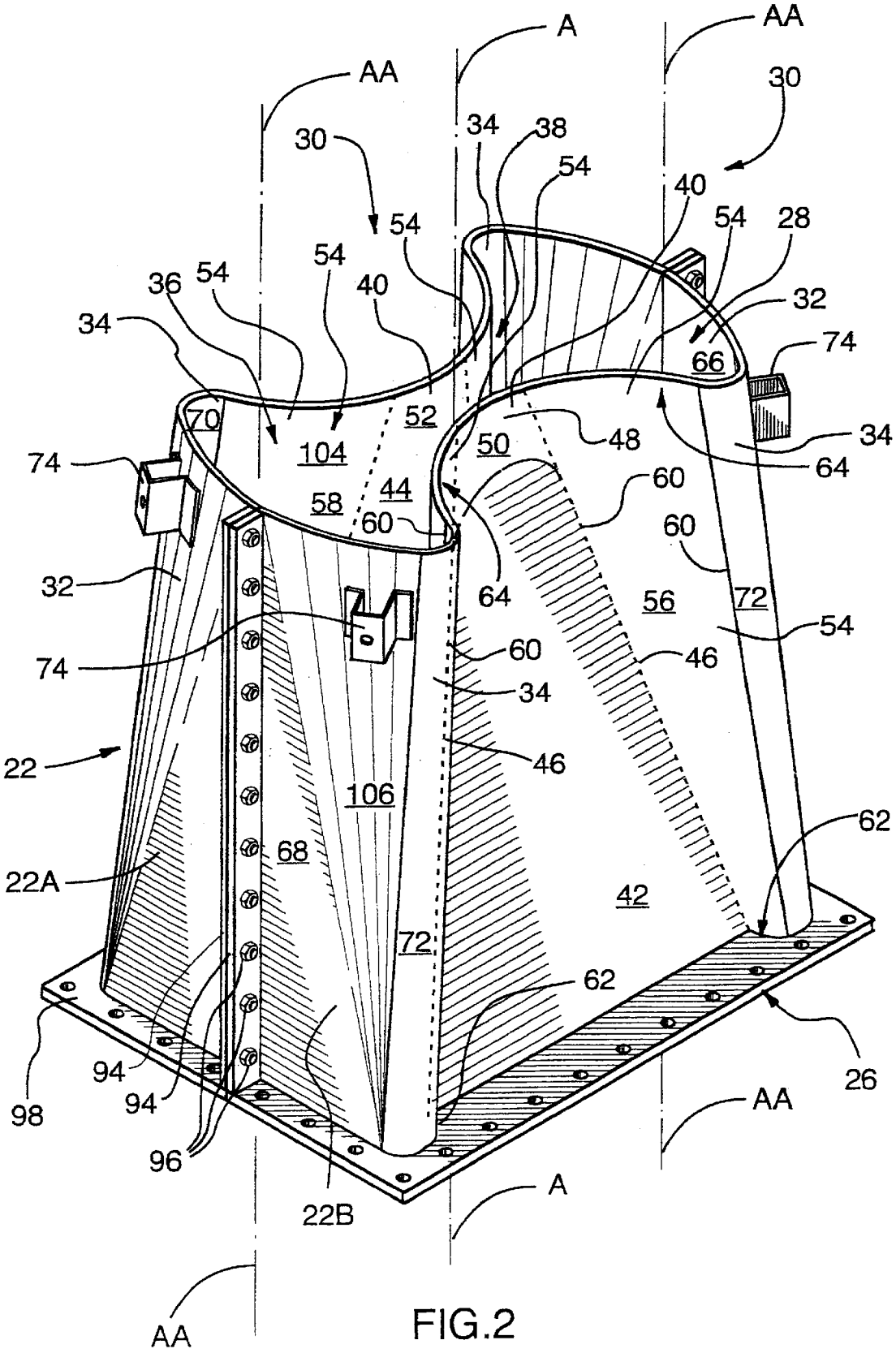
FIG. 2 is a perspective view of a base part or duct member of the nozzle of FIG. 1.

With reference to FIG. 1, a preferred embodiment of the present invention, an exhaust gas nozzle 20, is illustrated. The nozzle 20 will be seen to comprise a tubular body member or duct member 22 and an annular cap 24. As best indicated in FIG. 2, the duct member 22 defines an open first end 26, an open second end 28 and a centrally-disposed longitudinal axis A extending between the first end 26 and the second end 28. The duct member 22 forms a single exhaust passage 36 that extends between the first and second ends.

Figure 3:
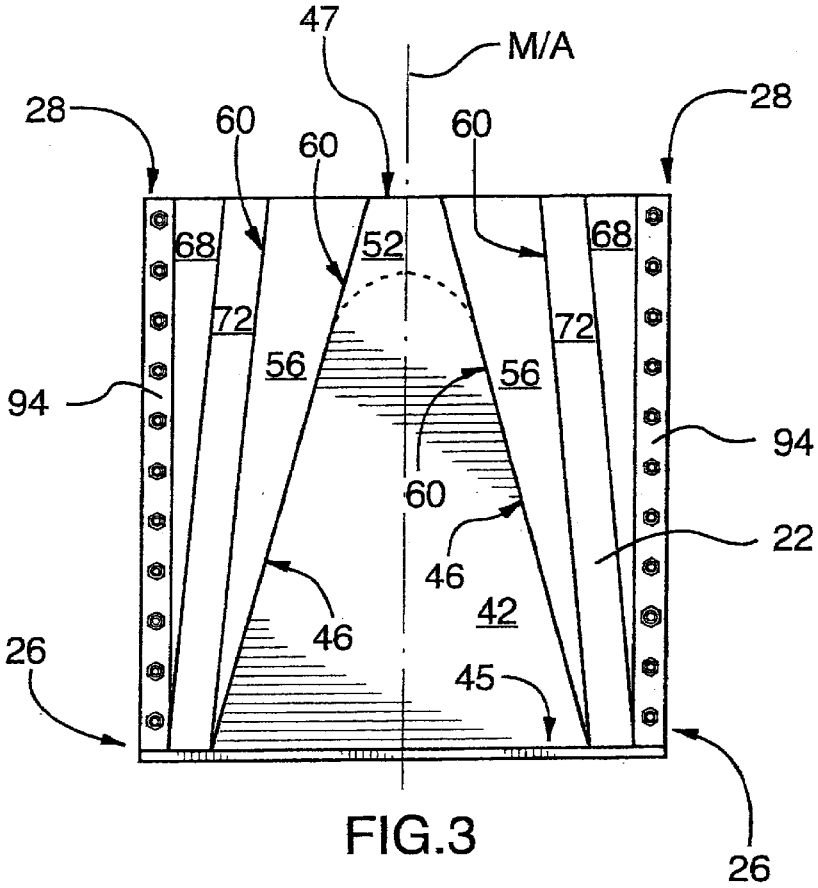
FIG. 3 is a side view along the medial plane of the duct member of FIG. 2.
Figure 4:
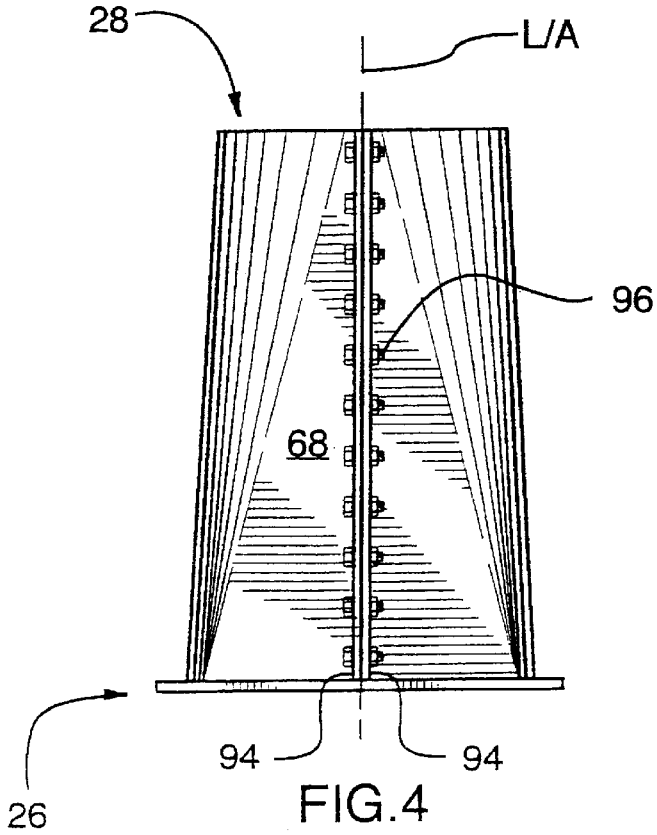
FIG. 4 is a side view along the lateral plane of the duct member of FIG. 2.
Figure 5:
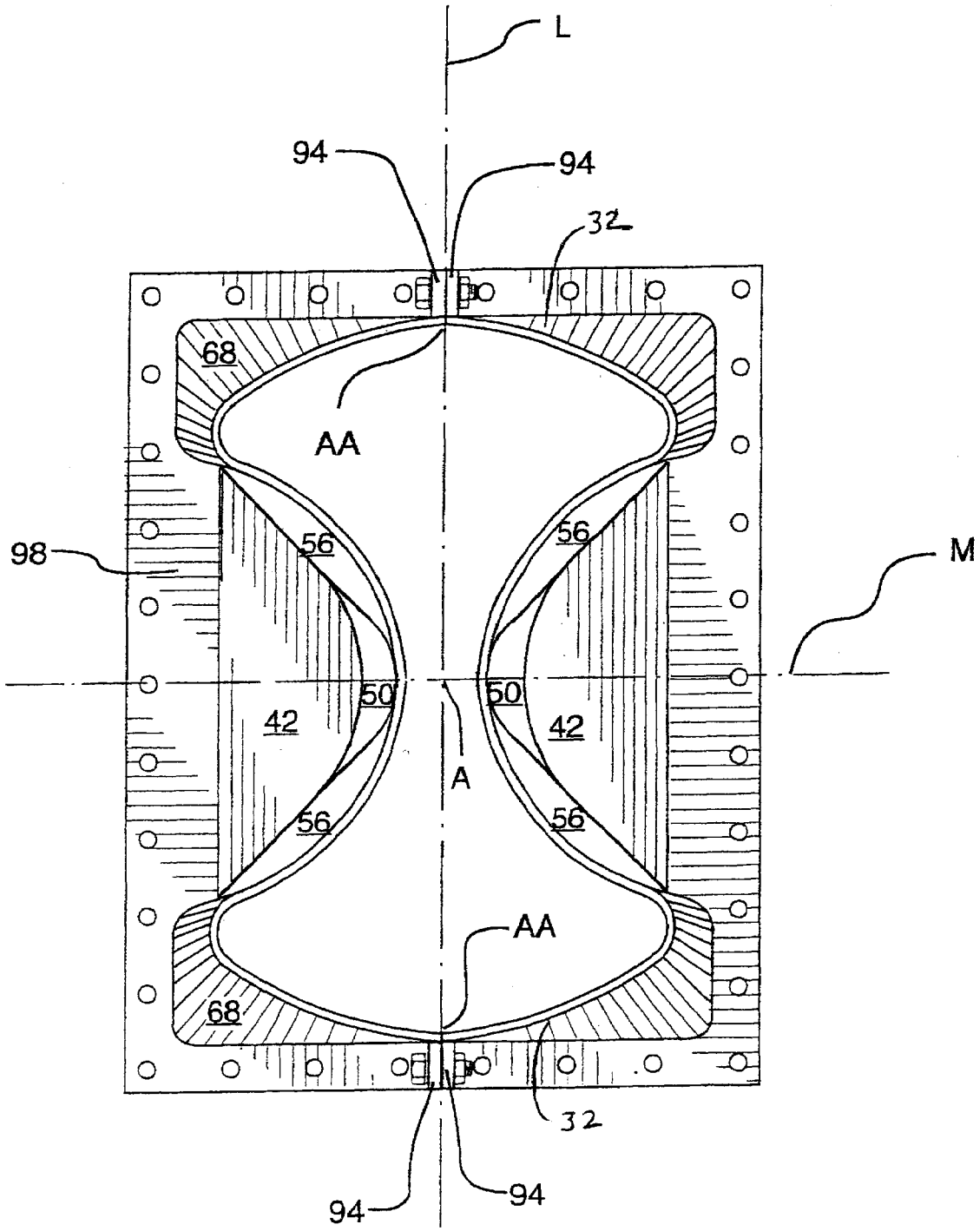
FIG. 5 is a top plan view of the duct member of FIG. 2.

The medial plane M parallel to and intersecting the longitudinal axis A is also defined by the body or duct member 22, as is a central lateral plane L parallel to and intersecting the longitudinal axis A and arranged perpendicular to the medial plane M, as illustrated in FIGS. 3, 4 and 5. When viewed along the lateral plane L in a direction normal to the longitudinal axis A, the duct member 22 tapers in profile from the first end 26 to the second end 28, as seen in FIG. 4.

As best seen in FIGS. 2 and 5, the duct member 22 is formed by a duct wall having a pair of flared portions 30 (also referred to herein as the "bent wall portions") spaced-apart from one another on opposite sides of the lateral plane L and a pair of sidewall portions 32, spaced-apart from one another on opposite sides of medial plane M. Each sidewall portion 32 is spaced laterally outwardly from the pair of flared portions 30. A pair of transition portions 34 for each sidewall portion 32 connects each sidewall portion 32 to a respective one of the pair of flared or bent wall portions 30. In such manner, the bent wall portions 30, the sidewall portions 32 and the transition portions 34 collectively define the single passage 36 for the flow of gases between the first end 26 and the second end 28. The bent wall potions 30 are distributed substantially evenly about the periphery of the duct member, that is, the periphery extending about the longitudinal axis A.

The bent wall portions 30 extend from the first end 26 to the second end 28 and gradually and increasingly pinch the passage in the direction of the second end 28 and define therebetween a flow restriction 38 in the passage 36, as indicated in FIG. 2. In the embodiment of the duct member shown in FIG. 5, it can be seen that the duct member collapses inwardly towards the centrally-disposed axis A in the two regions of the bent wall portions 30 which are bounded by the first end 26 and the second end 28. Each bent wall portion 30 in fact projects inwardly towards the longitudinal axis A as seen in transverse planes (perpendicular to the axis A) in the region of the second end 28.

Two spaced apart and elongate longitudinal channels are formed by the interior surface of the duct member 22, as well as by the exterior surface of the duct member 22. The two interior channels are bisected by the lateral plane L. The two exterior channels are bisected by the medial plane M. The interior and exterior channels extend to the second end 28 and are open at that end. They also gradually restrict the passage 36 towards the second end 28.

Each flared or bent wall portion 30 comprises a substantially planar central portion 40 extending roughly from the first end 26 to the second end 28 and aligned substantially normal to the medial plane M. The central portion 40 has a first end 45 located at the first end 26 of the body member 22; a second end 47 located at the second or top end 28 of the duct member 22; and a pair of sides 46, each extending from the first end 45 of the central portion 40 to the second end 47 of the central portion 40. The central portion varies in width, tapering in horizontal dimension from the first end 45 to the second end 47. In other words, the width of each central portion increases in the direction of the first end.

A substantial planar front face 42 extends between the sides 46 of the central portion 40 and from the first end 45 of the central portion 40 to the region of the second end 47. A substantially planar rear face 44 is disposed interiorly from the front face 42, is parallel therewith, and extends between the sides 46 of the central portion 40 and between the first end 45 and the second end 47. The central portion 40 has a lip 48 formed therein at the second end 47 thereof, this lip 48 having a concave exterior surface 50 and a convex interior surface 52.

Each flared or bent wall portion 30 also comprises a pair of elongate, curved perimeter portions located on opposite sides of the central portions. They project in a substantially horizontal direction from and are bounded on one side by the central portion 40 at the sides 46 thereof. Each perimeter portion 54 has a first end 62 adjacent the first end 26 of the body member 22 and a second end 64 at the second end 28 of the duct member 22. The perimeter portions taper in horizontal dimension from the second end 64 to the first end 62. A pair of sides 60 extend from the second end 64 of the perimeter portion 54 to the first end 62 of the perimeter portion 54 and taper towards one another in a downward direction. A concave exterior face 56 extends between the sides 60 of the perimeter portion 54 and between the first end 62 of the perimeter portion 54 and the second end 64. A convex interior face 58 extends between the sides 60 of the perimeter portion 54 and between the first end 62 of the perimeter portion 54 and the second end 64. The pair of perimeter portions 54 extend horizontally from the central portion 40 and then turn outwardly away from the central lateral plane L.

As best seen in FIG. 5, the aforementioned sidewall portions 32 each extend from the first end 26 to the second end 28 and intersect the lateral plane L in substantially linear relation to define a respective axis AA aligned substantially parallel to the lateral plane L. The sidewall portions 32 each have an inner side 66 and an outer side 68. The inner side 66 is substantially planar and parallel to the medial plane M at the first end 26, and becomes progressively and increasingly concave as the sidewall portion 32 extends towards the second end 28. The outer side 68 is also substantially planar and parallel to the medial plane M at the first end 26, and becomes progressively and increasingly convex as the sidewall portion 32 extends towards the second end 28.

Each transition portion 34 has a concave inside surface 70 and a convex outside surface 72 and is shaped and dimensioned to define, in combination with the sidewall portions 32 and the flared or bent wall portions 30, a smoothly contoured interior surface 104 of the duct member 22, and a smoothly contoured exterior surface 106 of the duct member 22.

The cap or windband 24 is connected to the body member 22 by brackets 74 and is disposed about the exterior of and in spaced substantially coaxial relation to the second end 28 of the body member 22, as best indicated in FIGS. 1 and 2. The cap 24 has a cap inlet or open bottom 76 located between the first end and the second end of the duct member and outside the duct member and a cap outlet or open top 78 located outwardly from or above the second end in the direction of the longitudinal axis A. The cap is substantially frustoconical in shape, tapering in diameter towards the cap outlet 78.

Figure 6:
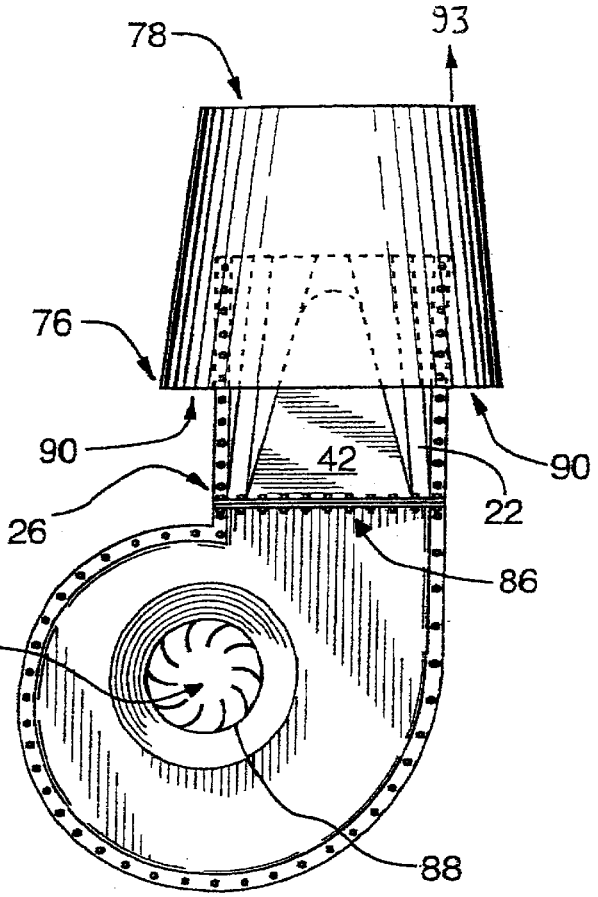
FIG. 6 is a side view along the medial plane of the exhaust gas nozzle of FIG. 1.
Figure 7:
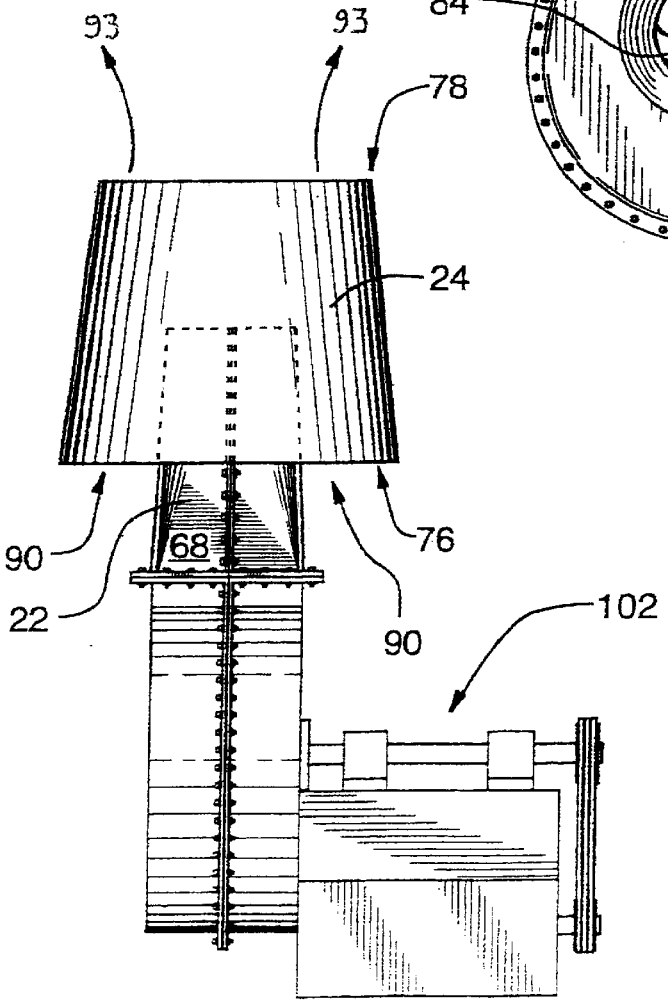
FIG. 7 is a side view along the lateral plane of the structure of FIG. 1.

In FIGS. 1, 6 and 7, an embodiment of the present invention is illustrated along with a fan apparatus 80. The fan apparatus 80 includes a fan housing 82 having fan inlet 84 to receive gas or air to be exhausted and a fan outlet 86 to expel gas or air to be exhausted, as best indicated in FIG. 6. Also provided is a radial fan 88, rotatably mounted within the fan housing 82 and adapted to draw exhaust gas or air in through the fan inlet 84 and to expel this gas out through the fan outlet 86. The radial fan 88 is connected to and driven by an external motor 102. With reference to FIGS. 1 and 2, flange 98 is provided at the first end 26 of the duct member 22, which, in turn, is joined by nut and bolt assemblies 96 of a mating flange 100 provided on the fan housing 82.

In use, the open first end 26 of the duct member 22 can be connected in sealed fluid communication with the fan outlet 86, such that gas drawn in through the fan inlet 84 is expelled through the fan outlet 86 as aforedescribed and thence through the nozzle 20 and thus propelled upwardly into the atmosphere as shown by arrow 93. Such action causes ambient air to be induced into the cap 24 as shown by arrows 90 to mix with the exhaust gases and therefore to dilute same as it is propelled upwardly. The cap or windband 24 and its associated purpose are known per se in the art. Similar windband structures are described in U.S. Pat. No. 4,806,076 and U.S. Pat. No. 5,439,349.

Figure 8:
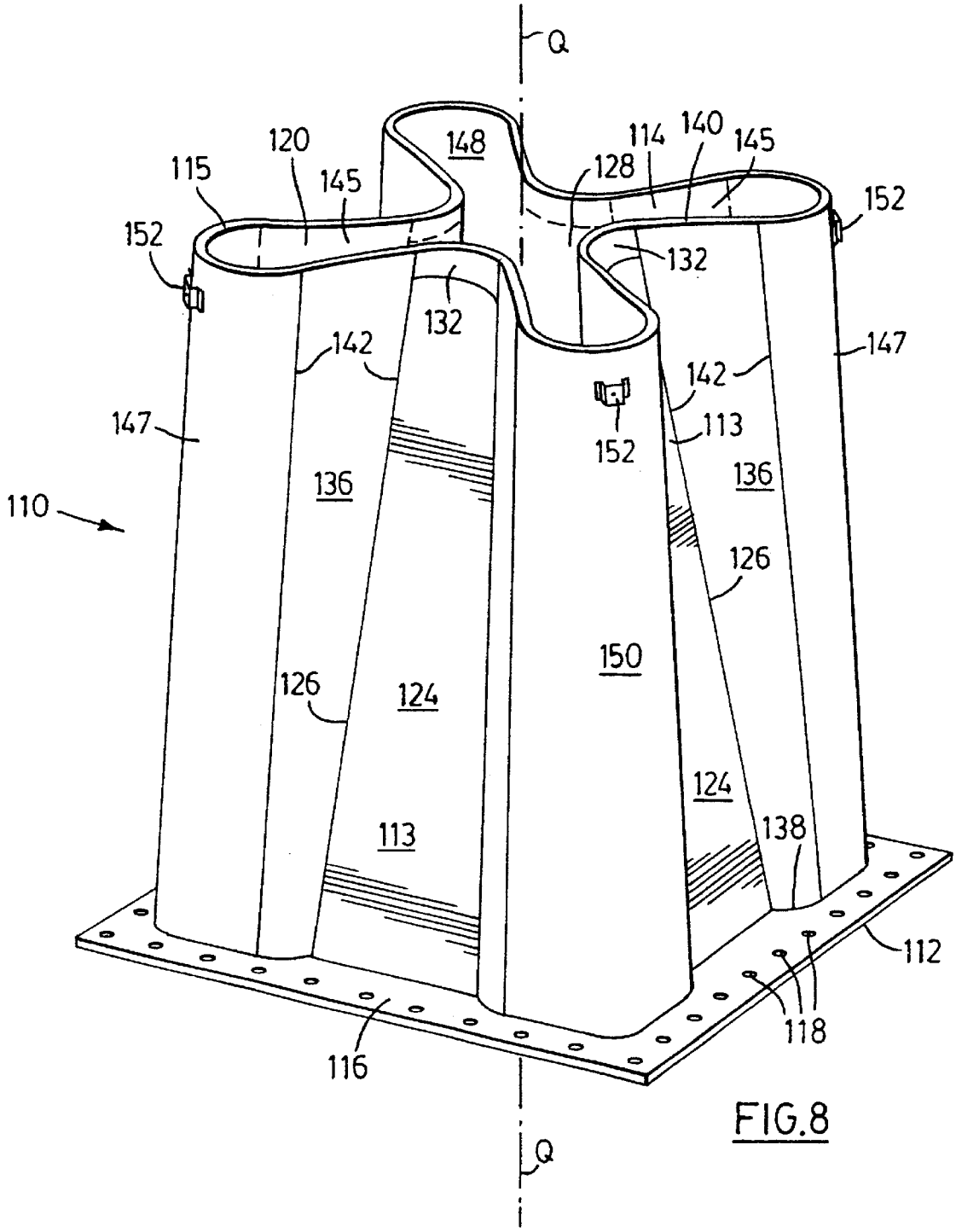
FIG. 8 is a perspective view of a second embodiment of a duct member constructed according to the invention.

FIG. 8 illustrates an alternative embodiment of the duct member having four flared portions or bent wall portions 113 instead of two. The duct member 110 defines an open first end 112, an open second end 114 and a centrally-disposed longitudinal axis Q extending between the first end 112 and the second end 114. In normal use of the duct member, the longitudinal axis Q extends vertically. A brim 115 extends around the top edge at the second end 114. A square or rectangular shaped flange 116 is provided at the end 112 of the body member 110. As explained below, it is also possible for the flange 116 to have a round circumferential edge. It will be appreciated that the orientation of the flange 116 with respect to rotation around the longitudinal axis Q and with respect to the remainder of the duct member 110 above it can be changed. The number of holes will vary based on a number of factors not limited to the dimensions of the flange 116 and the particular nuts and bolts employed for securing.

Figure 9:
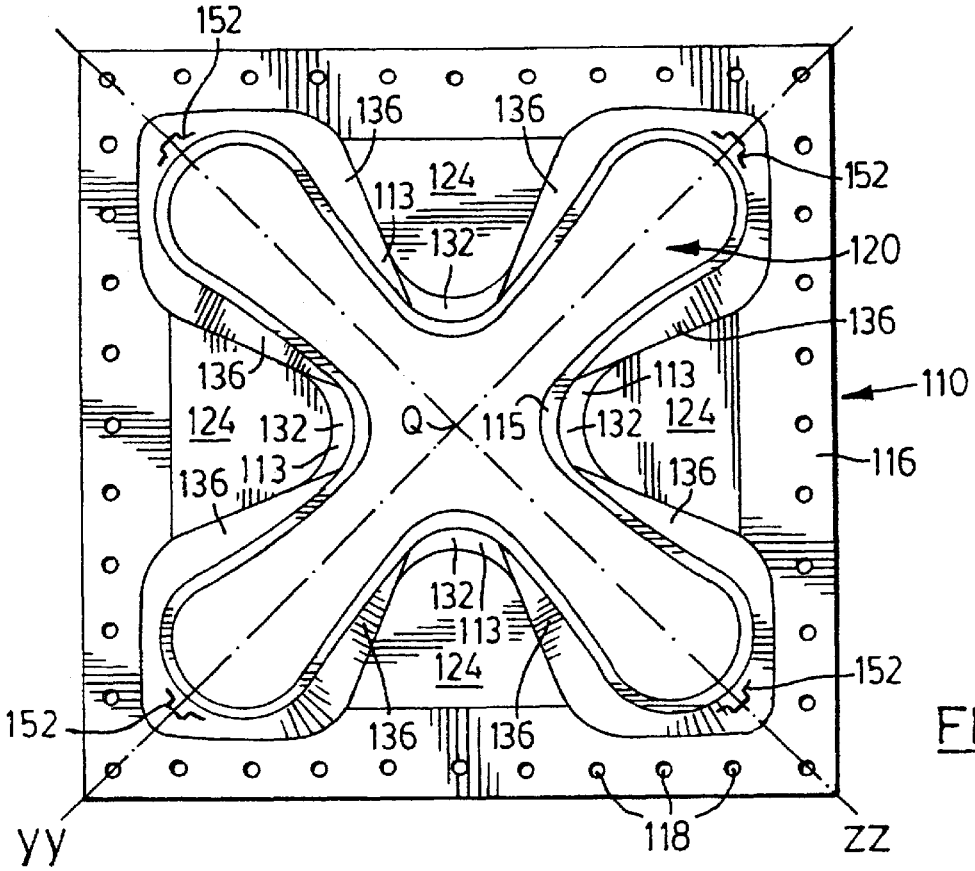
FIG. 9 is a top plan view of the duct member of FIG. 8.

Planes ZZ and YY intersect along the longitudinal axis Q, as illustrated in FIG. 9. These planes also cut through the flange 116 along its diagonals. It will be appreciated that the planes ZZ and YY are only perpendicular to each other if the flange 116 is square shaped (or possibly round). As best seen in FIG. 9, the planes YY and ZZ divide the body member 110 into four sections which border each other along the plane ZZ on one side, and the plane YY on the other. Each of the four flared portions or bent wall portions of the duct member 110 is within one of these four sections. A single passage 120 extends between the first end 112 and the second end 114 of the duct member 110 for the flow of gases. The bent wall portions gradually and increasingly pinch the passage 120, the passage being most restricted at the second end 114.

In the embodiment of the body member shown in FIG. 9, it can be seen that the tubular duct member collapses inwardly towards the centrally-disposed axis Q in four regions which are bound by the first end 112 and the second end 114. In each of the four regions of the bent wall portions 113, the brim 115 first curves inwardly towards the central axis Q of the duct member. At the inner end of each bent wall portion 113, the brim 115 curves outwardly away from the centre of the duct member.

Four spaced apart and elongate longitudinal channels are formed on the interior surface of the duct member 110, as well as on the exterior surface of the duct member 100. The interior and exterior surface channels extend to the second end 114 and are open at that end. They also gradually restrict the passage 120 towards the second end 114.

In this embodiment of the duct member 110, there are four planar front faces 124 in a respective one of four central portions. The central portions taper in horizontal dimension from the first end 112 to the second end 114. The faces 124 extend between sides 126. Substantially planar rear faces 128 are disposed interiorly from each of the respective front faces 124. Each central portion also includes a lip 132 having a concave exterior surface and a convex interior surface. A pair of elongate perimeter portions which include concave exterior faces 136 project in a substantially horizontal direction from and are bounded on their inner sides by the central portion at the sides 126. Each of the perimeter portions has a first end 138 and a second end 140. The perimeter portions taper in horizontal dimension from the second end 140 to the first end 138. A pair of sides 142 extend from the second end 140 of the perimeter portion to the first end 138 and taper towards one another in a downward direction. Convex interior faces 145 extend between the sides 142 of the perimeter portions and between the first ends 138 and the second or top ends 140. Four spaced-apart extremity portions 147 integrally connect adjacent perimeter portions. Each of the extremity portions 147 has a concave inside surface 148 and a convex outside surface 150. A bracket 152 is connected to each of the outside surfaces 150. It will be appreciated however that it would be possible to attach the brackets 152 at other locations on the body member. Also, the number of brackets employed is not essential to the proper connecting of the cap or windband to the duct member. The brackets 152 are for attaching the cap as described above.

Figure 10:
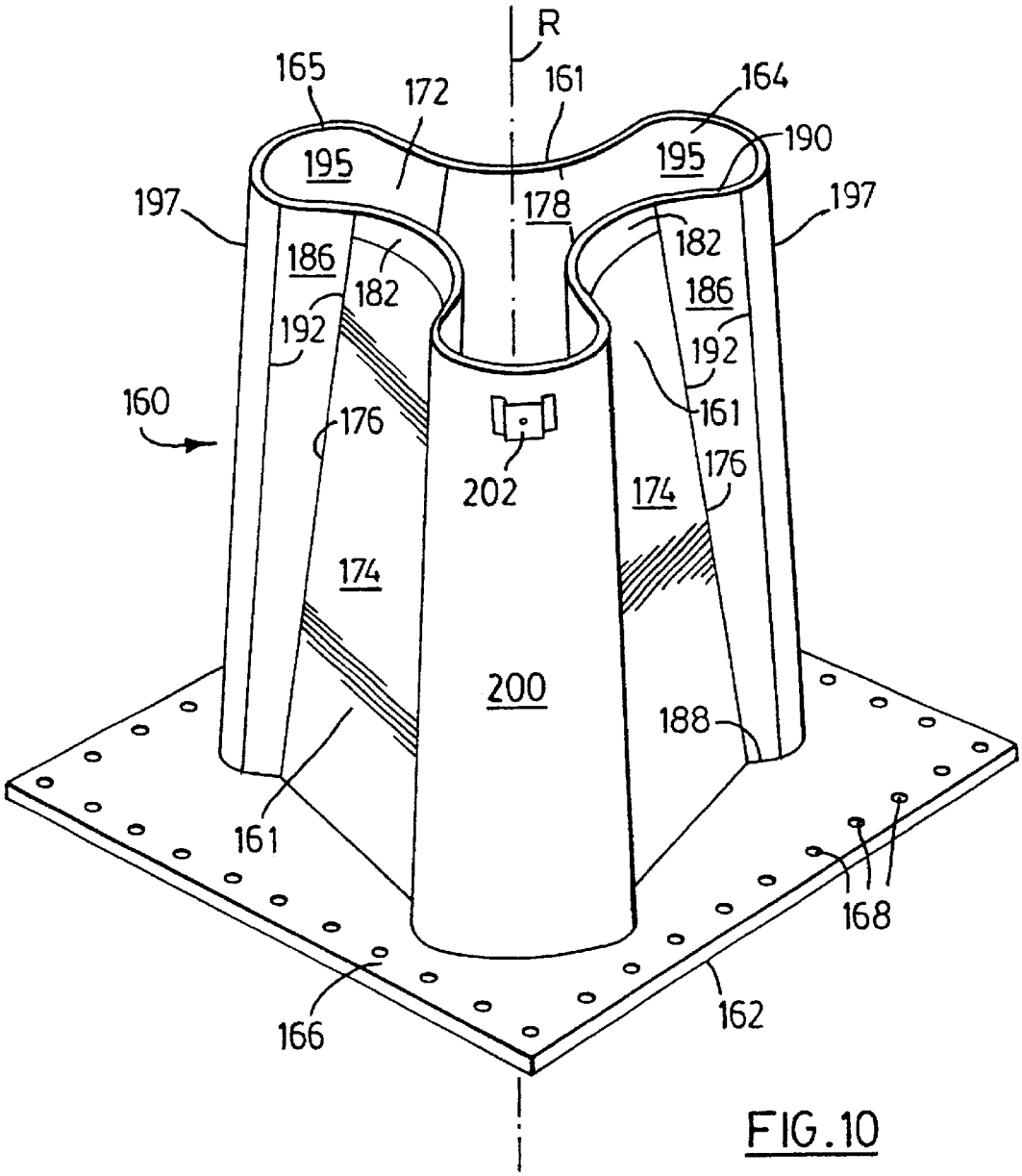
FIG. 10 is a perspective view of a third embodiment of a duct member that can be used as an exhaust gas nozzle.

FIG. 10 illustrates another alternative embodiment of the duct member having three flared or bent wall portions 161. The duct member 160 defines an open first end 162, an open second end 164 and a centrally-disposed longitudinal axis R extending between the first end 162 and the second end 164. A brim 165 forms the top edge at the second end 164. A square or rectangular shaped flange 166 is provided at the end 162 of the body member 160. A number of holes 168 are provided in the flange 166 for the nut and bolt assemblies. It will be appreciated that the orientation of the flange 166 with respect to rotation around the longitudinal axis R and with respect to the remainder of the body member 160 above it can be changed.

Figure 11:
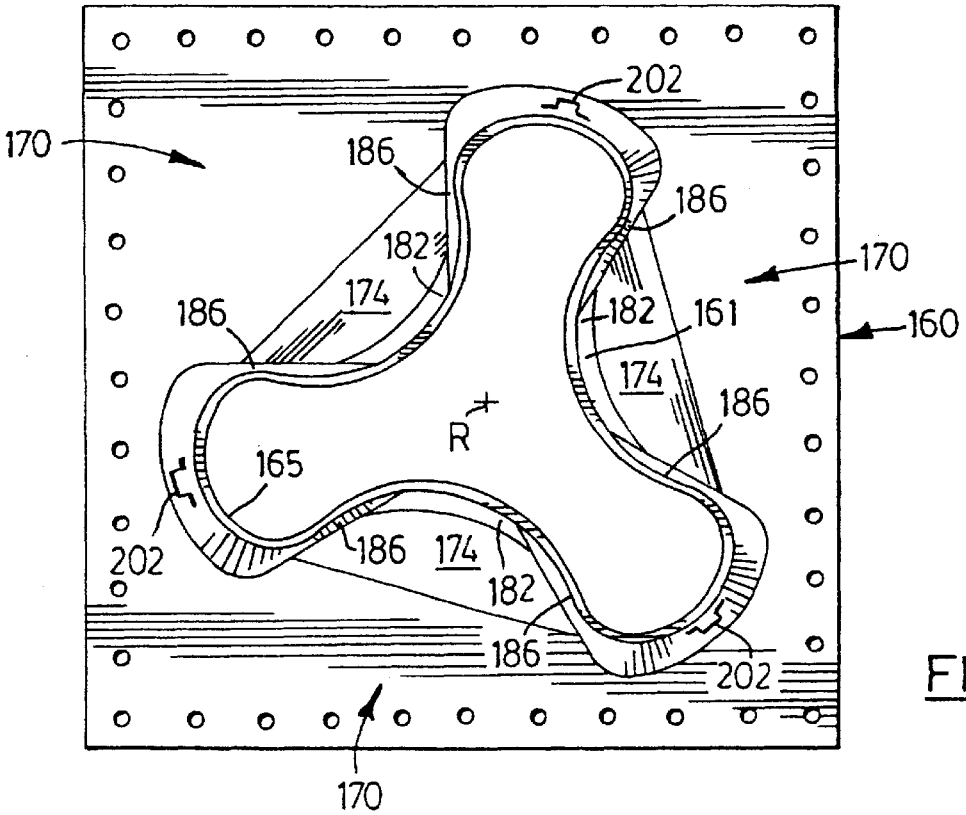
FIG. 11 is a top plan view of the duct member of FIG. 10.

For simplicity of description, planes similar to YY and ZZ in FIG. 9 have not been illustrated in FIG. 11. Nevertheless, the duct member 160 can be characterized as having three sections 170. Each of the bent wall portions 161 of the duct member 160 is within one of these three sections. A single passage 172 extends between the first end 162 and the second end 164 of the body member 160 for the flow of gases. The bent wall portions 161 gradually pinch the passage 172, the passage being most restricted at the second end 164.

In the embodiment of the body member shown in FIG. 11, it can be seen that the duct member collapses inwardly towards the centrally-disposed axis R in the three regions formed by the bent wall portions 161 which are bound by the first end 162 and the second end 164. The brim 165 curves inwardly towards the central axis R of the duct member. At the top of the bent wall portions, the brim 165 curves outwardly away from the central axis of the duct member.

Three spaced apart and elongate longitudinal channels are formed on the interior surface of the duct member 160, as well as on the exterior surface of the duct member 160. The interior and exterior surface channels extend to the second end 164 and are open at that end. They also gradually restrict the passage 172 towards the second end 164.

In this embodiment of the duct member, there are three planar central portions or front faces 174 formed by the bent wall portions 161. The central portions taper in horizontal dimension from the first end 162 to the second end 164. The faces extend between sides 176. Three substantially planar rear faces 178 are disposed interiorly of the duct member. Each bent wall portion has a lip 182 having a concave exterior surface and a convex interior surface. A pair of elongate perimeter portions which include concave exterior faces 186 project in a substantially horizontal direction from and are bounded on their inner sides by the respective central portion at the sides 176. Each of the perimeter portions has a first end 188 and a second end 190. The perimeter portions taper in horizontal dimension from the second end 190 to the first end 188. A pair of sides 192 extend from the second end 190 of the perimeter portion to the first end 188 and taper towards one another in a downward direction. Convex interior faces 195 of the perimeter portions are disposed interiorly of the duct member. The interior faces 195 extend between the sides 192 of the perimeter portions and between the first ends 188 and the second ends 190.

Each of three spaced-apart extremity portions 197 has a concave inside surface and a convex outside surface 200. The extremity portions 197 are more distant from the longitudinal axis R than the central portions 174. A bracket 202 is connected to each of the outside surfaces 200. It will be appreciated however that it would be possible to attach the brackets 202 at other locations on the duct member. Also, the number of brackets employed is not essential to the proper connecting of the cap to the duct member. The brackets 202 are for attaching the cap as described previously.

As illustrated in FIGS. 2, 3, 4 and 5, the preferred duct member is formed in multi-part construction. In the version of the duct member embodiment having two bent wall portions, the duct member comprises two parts 22A and 22B connected to one another by means of mating flanges 94 provided on each part 22A, 22B which are joined by nut and bolt assemblies 96.

It will be appreciated by one skilled in the art that the nozzle does not have to be connected to the housing 82 as illustrated in FIG. 1 in order for the nozzle to achieve the objects of the invention. What is referred to as a diffuser tube by those skilled in the art can be attached to the fan housing 82 by mating flange means. The diffuser tube would also be attached to the nozzle by mating flange means, and in this arrangement a bottom end of the diffuser tube is adjacent the outlet of the fan housing and a top end of the diffuser tube is adjacent the open bottom end of the nozzle. The diffuser tube typically has a frusto-conical shape with a passage which constricts from the top end of the tube to the bottom end. The nozzle can also be employed at the top end of a stack or exhaust duct of conventional construction.

Figure 14:
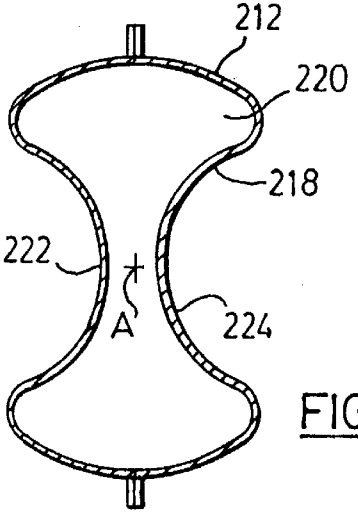
FIG. 14 is a cross-sectional view of the top end of the duct member in the nozzle of FIG. 12, this view taken along the line XIV—XIV of FIG. 12.
Figure 12:
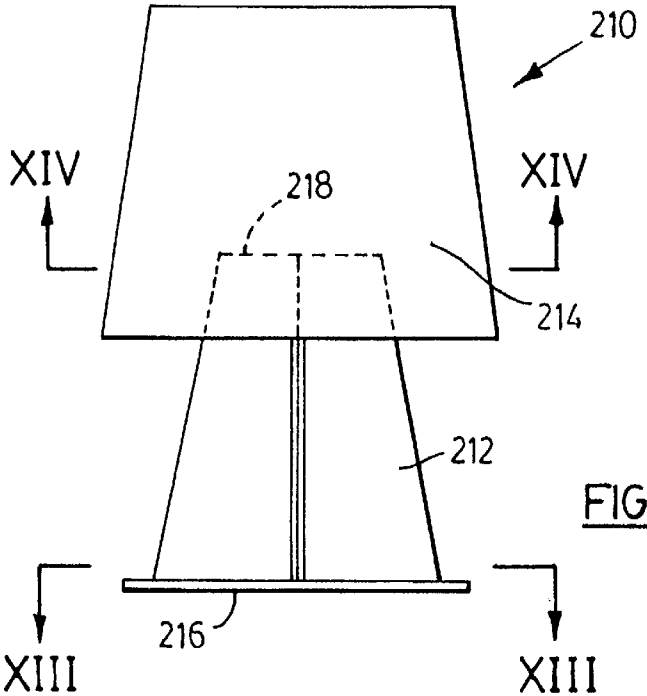
FIG. 12 is a schematic side view of a fourth embodiment of an exhaust gas nozzle.
Figure 13:
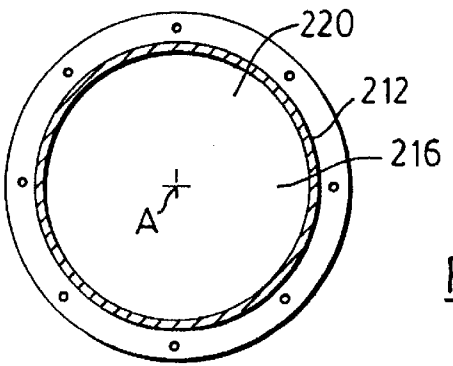
FIG. 13 is a cross-sectional view of the bottom end of the nozzle of FIG. 12, this view taken along the line XIII—XIII of FIG. 12.

A fourth embodiment of an exhaust gas nozzle suitable for an upblast fan is illustrated in FIGS. 12 to 14. This exhaust gas nozzle indicated generally at 210 can be constructed generally in the manner of the exhaust gas nozzle illustrated in FIGS. 1 to 5 except for the differences noted hereinafter. This nozzle has a vertically extending duct member 212 and an annular cap 214. The cap 214 is substantially the same in its construction as the cap 24 shown in FIG. 1 and, accordingly, a more detailed description of this particular cap or windband is deemed unnecessary.

The duct member 212 includes an open first end 216 and an open second end 218 and it has a centrally disposed longitudinal axis at A extending between the first end and the second end. The primary difference between this embodiment and that of FIGS. 1 to 5, is the fact that the duct member 212 is round at its first end 216 rather than rectangular or square. In addition, the single passage 220 that extends through this nozzle has a circular shape or cross-section at the first end. The advantage of this construction, of course, is that the nozzle 210 can be readily connected to a round fan outlet, if required, or it can be attached to a round outlet of a diffuser tube of the type referred to above. It will be understood that the shape of the second end 218, however, is similar to the shape at the top end of the duct member 22, this shape being shown in FIG. 14.

The illustrated nozzle 210 also has two bent wall portions 222 and 224 but it will be understood that the number of bent wall portions could in this version be increased to three or four in a manner similar to the above described duct members of FIGS. 8 to 11.

Finally, it is to be understood that various changes in size and shape of parts can be made beyond what has been illustrated and described. For example, only, while the nozzle of the present invention is shown in use with a radial fan driven by an external motor, it will be evident that other fan mechanisms, including fan mechanisms with motors positioned within the housing, can be utilized with equal utility. The nozzle of the invention can also be connected to an outlet of an inline centrifugal fan or a mixed flow inline fan. It is to be understood that the duct member can readily be constructed as a unitary part, or of several parts joined together by conventional means such as bolting, or by less conventional means such as welding, for example. Additionally, it should be appreciated that the nozzle can be constructed out of a wide variety of materials including, but not limited to, fiberglass, galvanized steel, stainless steel and epoxy-coated steel. It will be evident that these modifications, and others which may be obvious to persons of ordinary skill in the art, may be made without departing from the spirit or scope of the invention, which is accordingly limited only by the claims appended hereto, purposively construed.

We claim:

1. An exhaust gas nozzle comprising:

a duct member forming a single exhaust passage that extends from an open first end to an open second end of said duct member, a centrally disposed longitudinal axis extending between said first and second ends, said duct member being formed by a duct wall having at least two longitudinally extending bent wall portions that are distributed substantially evenly about the periphery of the duct member which extends about said longitudinal axis, each bent wall portion projecting inwardly towards said longitudinal axis as seen in transverse planes in the region of said second end whereby said bent wall portions gradually and increasingly pinch said single passage in the direction of said second end; and an annular cap connected to said duct member and disposed about the exterior of and in spaced, substantially coaxial relation to said second end of the duct member, said cap having a cap inlet located between said first end and said second end of the duct member and outside said duct member and a cap outlet located outwardly from said second end in the direction of said longitudinal axis.

2. An exhaust gas nozzle according to claim 1 wherein there are only two of said bent wall portions which are located diametrically opposite one another.

3. An exhaust gas nozzle according to claim 1 wherein each bent wall portion has a substantially planar central portion extending from said first end to the region of said second end and said central portion varies in its width, which increases in the direction of said first end.

4. An exhaust gas nozzle according to claim 3 wherein each bent wall portion also comprises a pair of curved perimeter portions located on opposite sides of said central portion and extending from said first end of the duct member to said second end thereof.

5. An exhaust gas nozzle according to claim 1 wherein there are three of said bent wall portions distributed about the periphery of the duct member.

6. An exhaust gas nozzle according to claim 1 wherein there are four of said bent wall portions distributed about the periphery of the duct member.

7. An exhaust gas nozzle according to claim 2 wherein said duct member includes a pair of further wall portions located on opposite sides of a medial plane that is parallel to and intersects said longitudinal axis, and each further wall portion extends from said first end to said second end of the duct member and forms an inwardly facing, concave inner wall surface at said second end.

8. An exhaust gas nozzle according to claim 2 wherein said duct member is round at said first end.

9. An exhaust gas nozzle according to claim 1 wherein said annular cap is substantially frustoconical in shape, tapering in diameter towards the cap outlet.

10. An exhaust gas nozzle according to claim 2 wherein said duct member is made of two similar half sections each of which extends from said first end to said second end, and each half section is formed with connecting flanges along longitudinal edges thereof for joining together the two half sections.

11. An exhaust gas nozzle comprising a vertically extending duct member forming an exhaust passage that extends from an open bottom end to an open top end of the duct member, a centrally disposed, vertically extending, longitudinal axis extending between said first and second ends, said duct member being formed by a duct wall that extends peripherally around said longitudinal axis and that has at least two longitudinally extending, bent wall portions distributed substantially evenly about the periphery of the duct member, said bent wall portions gradually and increasingly pinching said passage in the direction of said second end by bending and projecting radially inwardly towards said longitudinal axis as seen from said top end of the duct member.

12. An exhaust gas nozzle according to claim 11 including an annular open-ended cap connected to said duct member and disposed about the exterior of and in spaced, substantially coaxial relation to said second end of the duct member, said cap having a cap inlet located in the region of said second end and outside said duct member and a cap outlet located above said second end.

13. An exhaust gas nozzle according to claim 12 wherein there are only two of said bent wall portions which are located on diametrically opposite sides of said duct member.

14. An exhaust gas nozzle according to claim 12 wherein there are three of said bent wall portions which are evenly distributed about said longitudinal axis.

15. An exhaust gas nozzle according to claim 11 wherein there are four of said bent wall portions with each located on a respective one of four sides of the duct member.

16. An exhaust gas nozzle according to claim 12 wherein said duct member is round at said first end and said passage is also round at said first end.

17. An exhaust gas nozzle according to claim 12 wherein said duct member is made of two similar half sections each of which extends from said first end to said second end, and each half section is formed with connecting flanges along longitudinal edges thereof for joining together the two half sections.

18. An exhaust gas nozzle according to claim 12 wherein the annular cap is substantially frustoconical in shape, tapering in diameter towards the cap outlet.

19. A fan apparatus comprising:

a fan housing having a fan inlet adapted to receive gas or air to be exhausted and a fan outlet to expel the gas or air from the housing, a fan rotatably mounted within said fan housing and adapted to draw the gas or air in through said fan inlet and to expel the gas or air through said fan outlet; and an exhaust gas nozzle connected to said fan housing at said fan outlet, said gas nozzle including a vertically extending duct member forming an exhaust passage that extends from an open bottom end to an open top end of the duct member, a centrally disposed, vertically extending, longitudinal axis extending between said first and second ends, said duct member being formed by a duct wall that extends peripherally around said longitudinal axis and that has at least two longitudinally extending, bent wall portions distributed substantially evenly about the periphery of the duct member, said bent wall portions gradually and increasingly pinching said passage in the direction of said second end by bending and projecting radially inwardly towards said longitudinal axis as seen from said top end of the duct member.

20. A fan apparatus according to claim 19 including an annular, open-ended windband connected to said duct member and disposed about the exterior of and in spaced, substantially coaxial relation to said second end of the duct member, said wind band having a wind band inlet located below and in the region of said second end and outside said duct member and a wind band outlet located above said second end.

* * * * *